United States Patent [19]

Kawamura et al.

[11] Patent Number: 4,489,149

[45] Date of Patent: Dec. 18, 1984

[54] ELECTROPHOTOGRAPHIC AMORPHOUS SILICON MEMBER

[75] Inventors: Takao Kawamura, Sakai; Masazumi Yoshida, Amagasaki, both of Japan

[73] Assignees: Minolta Camera Kabushiki Kaisha; Takao Kawamura, both of Osaka; Kyocera Corporation, Kyoto, all of Japan

[21] Appl. No.: 562,733

[22] Filed: Dec. 19, 1983

Related U.S. Application Data

[63] Continuation of Ser. No. 490,212, May 6, 1983, abandoned, which is a continuation of Ser. No. 254,189, Apr. 14, 1981, abandoned.

[30] Foreign Application Priority Data

| | | | |
|---|---|---|---|
| May 8, 1980 | [JP] | Japan | 55-62111 |
| Oct. 13, 1980 | [JP] | Japan | 55-144189 |
| Nov. 8, 1980 | [JP] | Japan | 55-157335 |

[51] Int. Cl.[3] ..... G03G 5/082

[52] U.S. Cl. ..... 430/65; 430/95; 252/501.1; 427/74; 357/2

[58] Field of Search ..... 430/60, 65, 84, 95, 430/133, 136; 252/501.1; 204/192 P; 427/39, 74, 85; 357/2

[56] References Cited

U.S. PATENT DOCUMENTS

| | | | |
|---|---|---|---|
| 4,147,667 | 4/1979 | Chevallier et al. | 252/501.1 |
| 4,217,374 | 8/1980 | Ovshinsky et al. | 430/84 X |
| 4,225,222 | 9/1980 | Kempter | 430/84 X |
| 4,226,898 | 10/1980 | Ovshinsky et al. | 430/84 X |
| 4,265,991 | 5/1981 | Hirai et al. | 430/64 |

FOREIGN PATENT DOCUMENTS

| | | | |
|---|---|---|---|
| 54-145539 | 11/1979 | Japan | 430/84 |
| 54-145550 | 11/1979 | Japan | 430/84 |

OTHER PUBLICATIONS

"Electronic Properties of Substitutionally Doped Amorphous Si and Ge", Spear et al., Phil. Mag., vol. 33, No. 6, (1976), pp. 935-949.

"Amorphous Si-H-Fl-O Alloys", Feldman, Jour. Non-Cryst. Solids, 35 and 36, pp. 309-312, (1980).

*Primary Examiner*—Roland E. Martin

*Attorney, Agent, or Firm*—Watson, Cole, Grindle & Watson

[57] ABSTRACT

The invention disclosed relates to an electrophotographic sensitive member having a photoconductive layer of amorphous silicon. The photoconductive layer is preferably formed by the glow discharge process and includes about $10^{-5}$ to $5\times10^{-2}$ atomic % of oxygen, about 10 to 40 atomic % of hydrogen and about 10 to 20000 ppm of a Group IIIb impurity of the Periodic Table. A barrier layer of amorphous silicon having a thickness of about 0.2 to 5 microns and containing about 0.05 to 1 atomic % of oxygen may also be formed between a substrate and said photoconductive layer.

6 Claims, 6 Drawing Figures

ELECTROPHOTOGRAPHIC AMORPHOUS SILICON MEMBER

This application is a continuation application of application Ser. No. 490,212, filed May 6, 1983, now abandoned, which in turn was a continuation application of application Ser. No. 254,189, filed Apr. 14, 1981, now abandoned.

BACKGROUND OF THE INVENTION

1. Field of the Invention

The present invention relates to an electrophotographic sensitive member having a photoconductive layer of amorphous silicon.

2. Description of the Prior Art

Electrophotographic sensitive members of various types have already been proposed. Among other things, attention has been focused on the application to such sensitive members of amorphous silicon (hereinafter abbreviated as "a-Si") which is produced by the processes such as glow discharge and sputtering and to which research and development work has been directed in the field of semicounductors in recent years. This is attributable to the fact that photosensitive members of a-Si are much superior to those of selenium or CdS with respect to heat resistance, abrasion resistance and photosensitive characteristics, and also from the viewpoint of environmental pollution. A photosensitive member comprising a photoconductive layer of a-Si is proposed in U.K. Patent Application No. 2,013,725 (published Aug. 15, 1979).

Having actually conducted research on the application of a-Si to electrophotographic sensitive members, the inventors have found that the sensitive member of a-Si, unlike the conventional sensitive members, has the ideal characteristics of causing no pollution and being outstanding in heat resistance, surface hardness, abrasion resistance, etc. However, the inventors have encountered the problem that when the usual glow discharge or sputtering process is resorted to for the preparation of a-Si, the resulting photoconductive layer has a dark volume resistivity of as low as up to about $10^{10}$ ohm-cm, is not chargeable even to the lowest of the surface potential levels required for forming images by the Carlson process and is therefore unusable as it is for the sensitive member suited to the Carlson process which comprises the steps of charging, exposure to the original image, development, transfer, cleaning and charge erasing.

As reported by W. E. Spear and P. G. Le Comber in "Electronic Properties of Substitutionally Doped Amorphous Si and Ge," Philosophical Magazine, Vol. 33, No. 6, pp. 935-949, 1976 in the field of semiconductors, a-Si, when in a pure form free from impurities, acts usually as an N-type semiconductor with its structural defect providing a doner level, and when having incorporated therein a Group Vb impurity element of the Periodic Table, usually phosphorus (P), serves as an intensified N-type semiconductor, whereas a-Si serves as a P-type semiconductor when containing a group IIIa impurity element, usually boron (B), added thereto. The dark resistivity of a-Si varies in accordance with the impurity content. In fact, the report shows that addition of $B_2H_6$ and $SiH_4$ the material of a-Si, in an amount of $10^{-4}$ to $10^{-5}$ in mole ratio (200 to 20 ppm) results in an increased dark resistivity of about $10^{11}$ ohm-cm. However, use of a larger amount of boron entails a marked decrease in dark resistivity, because the effect achieved by the addition of impurities to a-Si is generally lower than is the case with crystalline Si and is much lower when the a-Si is used for electrophotographic photoconductive layers. According to the above-mentioned U.K. Patent Application No. 2013725, the preferred amount of a Group IIIa impurity element to be added is $10^{-3}$ to $10^{-6}$ atomic % (corresponding to $5\times10^{-6}$ to $5\times10^{-9}$ in $B_2H_6/SiH_4$ mole ratio or 0.01 to 10 ppm) which is exceedingly lower than the amount proposed by W. E. Spear et al. in the field of semiconductors. It is therefore thought that with a-Si for use as an electrophotographic photoconductive material, the addition of the Group IIIa impurity element is not useful for significantly controlling the electroconductivity (dark resistivity) and fails to give a greatly increased dark resistivity. In view of the situation described above, it is desired to provide sensitive members having a photoconductive layer of a-Si which is adapted to have incorporated therein a very small to large amount of impurities and the electroconductivity of which is easily controllable over a wide range.

It is also strongly desired to develop an a-Si photoconductive layer having a dark resistivity of at least about 10—ohm-cm as required by the electrophotographic image-forming process. To fulfill this requirement, Published Unexamined Japanese Patent Application No. SHO 54-145539 proposes to incorporate 0.1 to 30 atomic % of oxygen into a-Si and thereby improve the dark resistivity. When the inventors have actually prepared photoconductive layeers from a-Si containing at least 0.1 atomic % of oxygen and checked the layers for general electrophotographic characteristics, the layers were found to have an improved dark resistivity wich was well above the value required for the electrophotographic process. However, the photosensitive characteristics greatly reduced with an increase in the oxygen content and that even when having the lowest oxygen content of 0.1 atomic %, the layer was quite inferior to those of conventional photosensitive members in photosensitivity in the range of visible light.

Furthermore, sensitive members comprising an a-Si photoconductive layer formed directly over a conductive substrate and having an image-forming surface are low in production stability and reproducibility, and the electrophotographic characteristics of such sensitive members, especially the charge accepting capability and dark volume resistivity thereof, considerably vary from member to member even when they are produced by the same method. Thus the sensitive members in which the a-Si photoconductive layer is formed directly over a conductive substrate still remain to be substantially improved in manufacturing stability and reproducibility for actualy use.

SUMMARY OF THE INVENTION

Accordingly the main object of the present invention is to provide an electrophotographic sensitive member including a novel amorphous silicon photoconductive layer which has a high dark resistivity, outstanding charge accepting capability and high sensitivity.

Another object of the invention is to provide an electrophotographic sensitive member having a photoconductive layer of amorphous silicon which is produced by the glow discharge process and which, in addition to having excellent characteristics with respect of pollution-free properties, heat resistance, surface hardness, abrasion resistance, etc., is sufficiently high in dark resistivity and outstanding in general electrophotographic characteristics including photosensitive properties, the photoconductive layer being adapted to have incorporated therein a very small to large amount of impurities and possess electroconductivity which is easily controllable over a wide range.

Still another object of the invention is to provide an electrophotographic sensitive member having as its image-forming surface layer an amorphous silicon photoconductive layer which is formed by the glow discharge process and which is outstanding in production stability and reproducibility and stable in general electrophotographic characterstics.

These and other objects of the invention can be achieved by providing an electrophotographic sensitive member having an amorphous silicon photoconductive layer which is formed by the glow discharge process and which has incorporated therein about $10^{-5}$ to about $5\times10^{-2}$ atomic % of oxygen, about 10 to about 40 atomic % of hydrogen and about 10 to about 20000 ppm of a Group IIIa impurity element of the Periodic Table. Further when desired, the sensitive member may include, between the a-Si photoconductive layer and its conductive substrate, a barrier layer of an amorphous silicon barrier layer formed by the glow discharge process, having a thickness of about 0.2 to about 5 microns and containing about 0.05 to about 1 atomic %, preferably about 0.05 to about 0.5 atomic %, of oxygen.

DESCRIPTION OF THE PREFERRED EMBODIMENTS

Figure 1:
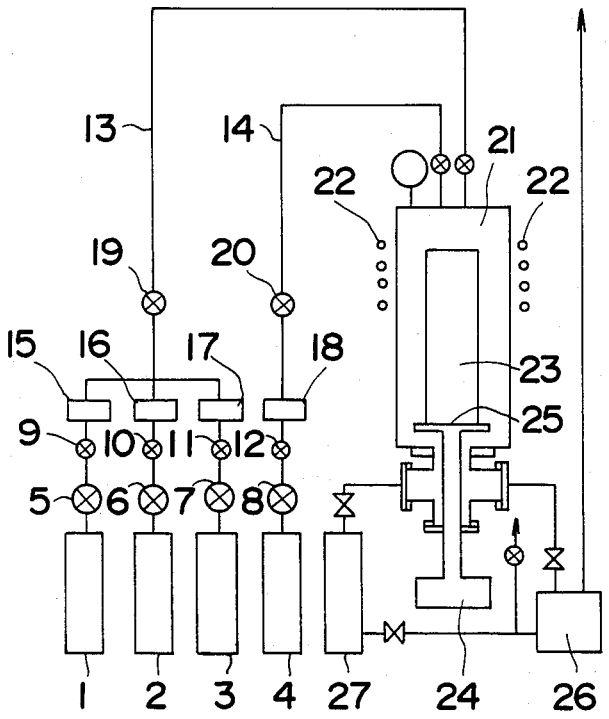
FIG. 1 is a diagram schematically showing the construction of a glow discharge apparatus for forming amorphous silicon photoconductive layers containing oxygen and hydrogen according to this invention.

As already described, the a-Si produced by the glow discharge process or by the sputtering process becomes a P-type semiconductor or an N-type semiconductor when having incorporated therein a Group IIIa impurity element (preferably boron) of the Periodic Table or, a Group Vb impurity element (preferably phosphorus). A-Si layers are formed by the use of $SiH_4$, $Si_2H_6$, $Si_3H_8$ gas as the starting material, in combination with diborane gas ($B_2H_6$ gas) for the addition of boron or with $PH_3$ gas for the addition of phosphorus. For these gases, hydrogen, argon, helium or the like is used as a carrier gas. Accordingly the a-Si layer contains at least hydrogen in its pure form and also when containing boron or phosphorus added thereto. However, as will become apparent from the experimental example to be given later, the a-Si layers formed from such materials had a dark resistivity which was less than $10^{10}$ ohm-cm at best and were not usable for the Carlson image-forming process which generally requires a dark resistivity of at least about $10^{13}$ ohm-cm.

The very low dark resistivity appears attributable to the presence of many dangling bonds in a-Si which is of amorphous structure. The term "dangling bonds" refers to the state in which Si atoms have free electrons without bonding or covalent bonds are broken. In the case of a-Si photoconductive layers, it is thought that many Si atoms are hanging loose without bonding in the state of dangling bonds in the vicinity of the surface and also in the interior thereof.

Stated in greater detail, a-Si is much less influenced than crystalline Si by the addition of impurities of a Group IIIa element or Group Vb element of the Periodic Table as already described, so that it is difficult to control the electroconductivity of a-Si through the control of the valency of either the P-type or N-type. It is thought that such difficulty results partly from the presence a localized level in the band gap (or mobility gap) due to the aforementioned many dangling bonds; the electrons or holes supplied from the donor or acceptor are captured by the localized level, so that the Fermi level can be moved only slightly, consequently presenting extreme difficulties in controlling the conductivity through the control of valency. However, since $SiH_4$, $B_2H_6$ and like gases are used for producing an a-Si film by the glow discharge process, the film contains hydrogen atoms which combine with and eliminate dangling bonds to reduce the localized level, with the result that the electroconductivity is controllable to some extent through the control of valency by the addition of impurities.

It has been found that inclusion of about 10 to about 40 atomic % of hydrogen into the a-Si photoconductive layer will cause hydrogen atoms to combine with a fairly large amount of dangling bonds to give a satisfactorily controlled electroconductivity, but the dark resistivity of the a-Si film was still found to be well below the desired level presumably because of the presence of many remaining dangling bonds, or of the weak and unstable bond between the hydrogen atom and the silicon atom. Especially the hydrogen-silicon bond is easily broken to release the hydrogen atom since the a-Si layer itself is formed in which the substrate must be heated to a high temperature.

To explore a solution to the problem of low dark sensitivity, the inventors have made further research and found that the dark resistivity can be improved greatly by incorporating a suitable amount of oxygen into the a-Si photoconductive layer in addition to the hydrogen content of about 10 to about 40 atomic %. The incorporation of oxygen eliminates almost all of the dangling bonds, with oxygen atoms attached strongly to Si having the dangling bonds. This appears useful for improving the dark resistivity. As will become apparent from some of the experimental examples given later, the a-Si photoconductive layers containing hydrogen and oxygen have a dark resistivity of at least $10^{13}$ ohm-cm which is about $10^2$ times to about $10^7$ times as high as those of like layers containing no oxygen. However, it has also been found that the photosensitivity of the a-Si layer decreases with an increase in the oxygen content and that the layer fails to exhibit good photoconductivity when containing an excess of oxygen. As will be described in detail later, the oxygen content of the a-Si photoconductive layer must therefore be about $10^{-5}$ to about $5\times10^{-2}$ atomic % and preferably about 0.01 to about 0.04 atomic %. For the incorporation of oxygen when employing the glow discharge process, oxygen is fed to the glow discharge reactor concurrently with, but independently of, $SiH_4$ gas. Since oxygen can be incorporated very efficiently, oxygen is fed in an amount about 1.1 to about 2 times the amount to be incorporated, for example, in a $O_2/SiH_4$ mole ratio of $0.55\times10^{-4}$ to $1\times10^{-4}$ when $10^{-2}$ atomic % of oxygen is to be contained. Insofar as the desired $O_2/SiH_4$ ratio is maintained, oxygen may be fed with use of air or $H_2$, Ar, He or like inert gas as a carrier gas.

Oxygen atoms, with their great electrically negative properties, readily share the electrons of dangling bonds with silicon atoms to effectively eliminate the bonds, so that the oxygen produces an exceedingly great effect even if incorporated in a fairly small amount of about $10^{-5}$ to $5\times10^{-2}$ atomic % as stated above. Furthermore the resulting strong bonds improve the heat resistance, other stabilities and durability of the photoconductive layer. As already mentioned, the oxygen content should be limited to at most $5\times10^{-2}$ atomic %. Otherwise a greatly reduced photosensitivity would result presumably because an excess of oxygen other than that eliminating the dangling bonds will combine with Si to form $SiO_2$ crystals which have a band gap of about 7 eV and are not photoconductive in the range of visible light. Conversely the oxygen content, when less than $10^{-5}$ atomic %, is unusable to fully eliminate the dangling bonds, failing to afford an a-Si photoconductive layer having a dark resistivity of not lower than $10^{13}$ ohm-cm.

With about 10 to about 40 atomic % of hydrogen and about $10^{-5}$ to about $5\times10^{-2}$ atomic % of oxygen present in the a-Si film, the dangling bonds therein have been eliminated almost completely, with an extremely reduced localized level present in the mobility gap, so that the Fermi level is controllable by the control of valency much more easily than heretofore possible although the layer is an amorphous semiconductor. In other words, the addition of trivalent or pentavalent impurities produces a remarkably improved effect. Especially a trivalent impurity element, such as boron, which is serviceable as the acceptor, can be incorporated in an amount ranging from a minium of about 10 ppm to a maximum of as much as 20000 ppm although the amount is partly dependent on the oxygen content, thus contributing a great deal to the provision of a-Si having a dark resistivity of at least $10^{13}$ ohm-cm.

Although the a-Si photoconductive layer containing oxygen, hydrogen and a Group IIIa impurity element according to this invention is usable in various forms, it is preferable to use the layer as a surface layer for forming images of electric charges on the surface thereof in view of its outstanding properties with respect to pollutant-free properties, resistance to heat, suface hardness, etc. For use as such, the layer has a thickness of about 5 to about 100 microns, preferably about 10 to 50 microns. Alternatively, the a-Si photoconductive layer may be used in a dual layered photosensitive member. For example, the a-Si layer of about 0.2 to 3 micron thick is formed on the substrate and a light transparent organic semiconductive layer of polyvinylcarbazole or pyrazoline is formed thereover into a thickness of about 10 to 40 microns. The a-Si layer may be used in various other forms and should be construed as included in the present invention as long as it acts as a photoconductive layer.

As already described, the a-Si photoconductive layer of this invention has incorporated therein about 10 to about 20000 ppm of a Group IIIa impurity element, preferably boron, in addition to oxygen and hydrogen. With less than about 10 ppm of the impurity element present, the layer fails to have a dark resistivity of at least about 10—ohm-cm which is required when the layer is used as an image-forming suface layer, whereas the presence of more than 20000 ppm of the element results in a markedly reduced dark resistivity. The group IIIa impurity element, e.g. boron, is incorporated into a-Si by feeding $B_2H_6$ gas into the glow discharge reactor along with $SiH_4$gas. Since the element will be incorporated less efficiently than oxygen, $B_2H_6$ must be fed in about 5 to about 15 times the amount to be contained.

The a-Si photoconductive layer of this invention exhibits spectral sensitivity characteristics over the range covering the visible spectrum and completely including the infra-red photographic range at the longer wavelength end of the spectrum. Insofar as the oxygen content is within the foregoing range, especially not exceeding the upper limit of $5\times10^{-2}$ atomic %, the layer has very satisfactory dark decay and light decay characteristics and considerably higher sensitivity than the conventional sensitive members of the Se type and those of TNF-containing polyvinylcarbazole.

Furthermore, the a-Si layer of this invention has a surface hardness (Vickers hardness) of about 1800 to about 2300 kg/mm$^2$ which is about 30 to about 40 times the hardness of Se-As sensitive members (As 5%) and about 18 to 23 times the hardness of aluminum. Thus the layer is as hard as sapphire. Accordingly the layer is well suited to the pressure transfer of toner images and is cleanable by a metal blade. Since the a-Si has a crystallization temperature of as high as about 700° C., the layer is also amenable to heat transfer and has outstanding overall durability.

However, it has been found that the a-Si photoconductive layer, when formed directly on an electroconductive substrate, can not always be prepared with very high reproducibility. Stated more specifically, when a large number of photosensitive members were prepared under the same conditions, each with an a-Si photoconductive layer formed directly on a conductive substrate, and then checked for general electrophotographic characteristics, some variations were found especially in charge accepting capacity and dark resistivity, and some members were found unchargeable to the desired surface potential. Accordingly there is the need to substantially minimize the variations in the charge accepting capacity due to the unstability of the production reproducibility. Additionally, the a-Si photoconductive layer itself, even if having a dark resistivity of at least 10—ohm-cm, inevitably suffers from a reduction in its charge accepting capacity due to the injection of charges from the conductive substrate.

In view of these problems, the present invention provides an embodiment which includes, between the foregoing a-Si photoconductive layer and the conductive substrate, an a-Si barrier layer formed by the glow discharge process and having a thickness of about 0.2 to about 5 microns and an oxygen content of about 0.05 to about 0.5 atomic %, the layer having an oxygen content of up to about 1 atomic % when about 0.2 to about 0.4 micron in thickness, to minimize the variations of the charge accepting capacity of the a-Si photoconductive layer due to the unstability of the production reproducibility and to render the photoconductive layer chargeable to a high potential by effectively preventing the injection of charges from the substrate. Although the conductive layer must have a thickness of several tens of microns in the prior art so as to be chargeable to a high potential, the a-Si barrier layer assures that the a-Si conductive layer can be charged to the desired potential even when having a thickness of up to 10 microns but not smaller than 5 microns.

When containing about 0.05 to about 0.5 atomic % of oxygen, the a-Si barrier layer has remarkably improved insulating properties and acts effectively as a barrier. The oxygen content should be at least about 0.05 atomic %; otherwise the a-Si barrier layer would not have noticeably increased resistance, failing to act as a barrier and to correct the variations of the charge accepting capacity. The oxygen content must not exceed about 0.5 atomic % because higher oxygen contents will result in a higher residual potential, making it impossible to obtain contrasty toner images. While the increase of the residual potential arises from the phenomenon that a large number of carriers produced in the a-Si photoconductive layer are trapped in the interface between the photoconductive layer and the a-Si barrier layer or in the barrier layer, the residual potential remains at a level that will involve no problems when the barrier contains about 0.05 to about 0.5 atomic % of oxygen and further has a thickness of about 0.2 to about 5 microns as will be described later.

Although the oxygen content has been described above as being limited to a maximum of 0.5 atomic %, the inventors have found that insofar as the a-Si barrier layer has a smaller thickness of about 0.2 to about 0.4 micron, the oxygen content can be up to about 1 atomic %, with the residual potential kept below a specified level.

It is preferable that the a-Si barrier layer be about 0.2 to about 5 microns in thickness, because when thinner than about 0.2 micron, the barrier layer no longer functions as such, failing to ensure a uniform charge accepting capacity for a-Si photoconductive layers. When the thickness exceeds 5 microns, the residual potential will be higher than the specified level, and the barrier will not have a rectifying function. As will be apparent from the foregoing description of the a-Si photoconductive layer, the a-Si barrier layer may contain, in addition to oxygen, up to 20000 ppm of a Group III*a* impurity element of the Periodic Table (preferably boron) and also about 10 to about 40 atomic % of hydrogen since the addition of such elements improves the dark resistivity of the a-Si barrier layer to some extent. This is useful in giving the barrier layer a dark resistivity at least not lower than is required, without incorporating an increased amount of oxygen thereinto. Although aluminum, stainless steel, etc., are usable for the electroconductive substrate, we have found that aluminum forms a satisfactory joint between the substrate and the a-Si barrier layer and ensures repeated use of the sensitive member over a prolonged period of time without separation or cracking. Other barrier layers may be formed instead and as an example of such a layer, $Al_2O_3$ layer formed by anodic oxidation is quite effective.

FIG. 1 shows a glow discharge apparatus for forming the a-Si barrier layer and the photoconductive layer. With reference to the drawing, first, second, third, fourth tanks 1, 2, 3, 4 have sealed therein $SiH_4$, $PH_4$, $B_2H_6$, $O_2$ gases, respectively. Hydrogen is used as the carrier gas for the $SiH_4$, $PH_4$ and $B_2H_6$ gases. These gases are released when first, second, third, fourth regulating valves 5, 6, 7, 8 corresponding thereto are opened respectively, and the flow rates of the gases are controlled by mass flow controllers 9, 10, 11, 12. The gases from the first to third tanks 1 to 3 are sent into a first main duct 13, and the oxygen gas from the fourth tank 4 into a second main duct 14 separately from these gases. Indicated at 15, 16, 17, 18 are flow meters, and at 19, 20 shut-off valves. The gases flowing through the first and second main ducts 13, 14 are fed to a reactor tube 21, which is surrounded by a resonance vibration coil 22, which suitably gives a high-frequency power of 100 watts to several kilowatts at a frequency of 1 MHz to several tens of MHz. Within the reactor tube 21, an electroconductive substrate 23, for example, of aluminum or NESA glass for forming an a-Si film thereon is placed on a turntable 25 which is rotatable by a motor 24. The substrate 23 per se is uniformly heated to about 50° to about 300° C., preferably about 150° to about 250° C., by suitably heating means. The interior of the reactor tube 21, which must be evacuated to a high vacuum (discharge pressure: 0.5 to 2.0 Torr) for the formation of the a-Si film, is in communication with a rotary pump 26 and a diffusion pump 27.

The a-Si photoconductive layer may be formed directly on the substrate 23 as already described, but an a-Si barrier layer may be formed first, in which case the same glow discharge apparatus as used for the photoconductive layer is usable. For convenience, therefore, the formation of the a-Si barrier layer will be described below first, followed by a description of the formation of the a-Si photoconductive layer.

To form an a-Si barrier layer with the glow discharge apparatus of the construction described, the interior of the reactor tube 21 is first evacuated by the diffusion pump 27 to a vacuum of about $10^{-4}$ to about $10^{-6}$ Torr, and the rotary pump 26 is thereafter alternatively operated to obtain a vacuum of about $10^{-2}$ to about $10^{-4}$ Torr. Oxygen is fed from the fourth tank 4 into the tube 21 and maintained at a predetermined pressure value by adjusting the mass flow controller 12. Subsequently $SiH_4$ gas is fed from the first tank 1 and, when desired, $B_2H_6$ gas from the second tank 2. With the interior of the reactor tube 21 maintained in a vacuum of about 0.5 to about 2.0 Torr, the substrate heated to a temperature of 50° to 300° C. and the coil 22 set for a high-frequency power of 100 W to several KW at a frequency of 1 to several tens of MHz, glow discharge occurs to decompose the gases and form an a-Si barrier layer over the substrate at a rate of about 0.5 to about 2 microns/60 minutes, the barrier layer having a predetermined oxygen content, with or without a suitable amount of boron contained therein.

When the a-Si barrier layer has been formed, the glow discharge is temporarily interrupted. The apparatus is thereafter started for the formation of an a-Si photoconductive layer. For this operation, $SiH_4$ gas and $O_2$ gas are similarly fed from the first and fourth tanks 1, 4, and $B_2H_6$ gas from the second tank 2 or $PH_3$ gas from the third tank 3. Glow discharge is effected substantially under the same conditions as for the formation of the barrier layer, whereby the desired a-Si photoconductive layer containing oxygen, hydrogen and a suitable amount of phosphorus or boron is formed over the a-Si barrier layer.

The present invention will be described below with reference to the following experimental examples. The dark resistivity, charge accepting capability and spectral sensitivity characteristics of a-Si photoconductive layers will be described in Experimental Example 1 to 4 and the charge accepting capability and residual potential characteristics as related to the formation of a-Si barrier layers in Experimental Examples 5 and 6.

EXPERIMENTAL EXAMPLE 1

A-Si photoconductive layers containing hydrogen but free from any oxygen were prepared and then checked for dark resistivity.

Using the glow discharge apparatus shown in FIG. 1, $SiH_4$ gas was released from the first tank 1 as carried by hydrogen (10% $SiH_4$ relative to hydrogen) and decomposed to form a 20-micron-thick pure a-Si photoconductive layer on an aluminum substrate. The production conditions used were: discharge pressure 1.5 Torr, temperature of aluminum substrate 200° C., high-frequency power 300 W, frequency 4 MHz, and rate of formation of the layer 1 micron per hour.

Next, 20-micron-thick a-Si photoconductive layers containing about 20, 200 and 2000 ppm of boron were formed on an aluminum substrate under the same conditions as above. These contents correspond to $10^{-5}$, $10^{-4}$ and $10^{-3}$, respectively, in terms of $B_2H_6/SiH_4$ mole ratio. Since the efficiency with which boron can be incorporated into the a-Si photoconductive layer is 1/5 to 1/15 as already mentioned, the $B_2H_6/SiH_4$ mole ratios used were about 10 times the contemplated boron contents. The boron contents were measured by a Hitachi ion microanalyzer.

Similarly a mixture of $SiH_4$ and $PH_3$ gases was fed to the reactor tube for glow discharge to form 20-micron-thick a-Si photoconductive layers containing 10, 100 and 1000 ppm of phosphorus.

Figure 2:
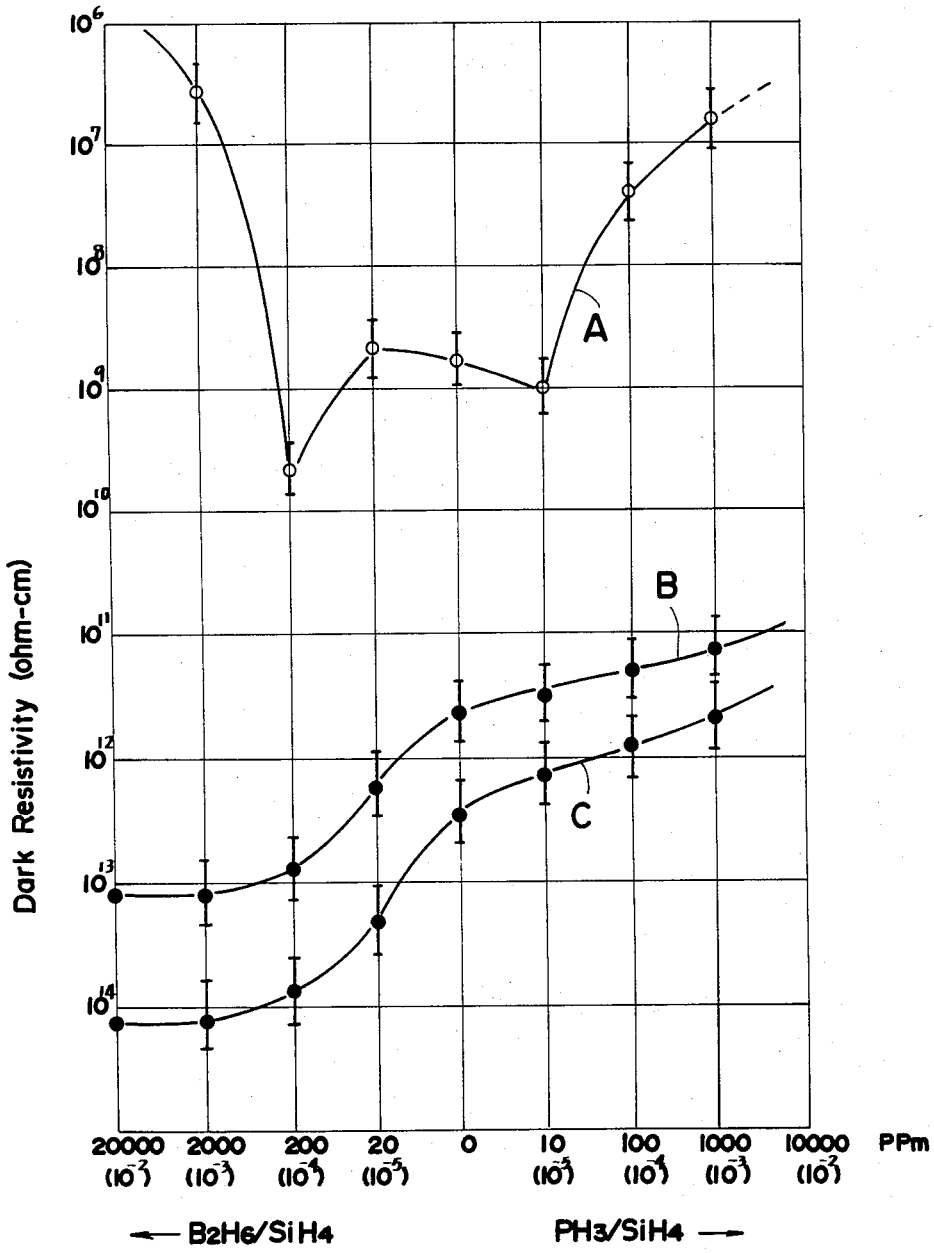
FIG. 2 is a diagram showing variations in the dark resistivity of oxygen-containing amorphous silicon and oxygen-free amorphous silicon which have incorporated therein varying amounts of boron or phosphorus.

The dark resistivities of the above a-Si photoconductive layers were then measured with the result represented by a solid line A in FIG. 2, in which the boron and phosphorus contents are in ppm, and the $B_2H_4/SiH_4$ and $PH_3/SiH_4$ mole ratios are given in parentheses. These mole ratios are shown on the assumption that the incorporating effeciency of the element concerned is 100%.

The solid line A of FIG. 2 indicates that the pure a-Si photoconductive layer has a dark resistivity of less than $10^9$ ohm-cm which does not increase even in the presence of 10 ppm of phosphorus. When the layer contains larger amounts of phosphorus, the dark resistivity markedly reduces; e.g. about $4\times10^7$ ohm-cm for 100 ppm of phosphorus, and about $8\times10^6$ ohm-cm for 1000 ppm of phosphorus. On the other hand, when containing boron, the a-Si layer exhibits at a boron content of about 200 ppm the highest resistivity of about $6\times10^9$ ohm-cm, which nevertheless abruptly decreases as the boron content further increases. The dark resistivity is as low as less than $10^7$ ohm-cm at 2000 ppm. It therefore follows that the a-Si layer containing hydrogen but free from any oxygen is less than $10^{10}$ ohm-cm in maximum dark resistivity despite the addition of boron or phosphorus and is not usable as an electrophotographic photoconductive layer which usually must have a dark resistivity of at least about $10^{13}$ ohm-cm. In fact, when an a-Si photoconductive layer with a boron content of 200 ppm was charged by corona discharge, the surface potential, whether of positive or negative polarity, was as low as less than several tens of volts.

EXPERIMENTAL EXAMPLE 2

A-Si photoconductive layers containing both hydrogen and oxygen were prepared and checked for dark resistivity.

An a-Si photoconductive layer, 20 microns in thickness, was prepared under the same conditions as in Experimental Example 1 except that oxygen was fed from the fourth tank 4 to the reactor tube in an $O_2/SiH_4$ mole ratio of about $0.75\times10^{-7}$ to incorporate about $10^{-5}$ atomic % of oxygen into the layer. Similarly prepared were a-Si photoconductive layers further containing 20, 200, 2000 and 20000 ppm of boron and those containing 10, 100 and 1000 ppm of phosphorus. Thus seven 20-micron-thick a-Si photoconductive layers were prepared, each with an oxygen content of about $10^{-5}$ atomic %. Each of these layers was found to contain about 18 to about 22 atomic % of hydrogen. The oxygen contents were determined by Spark Source mass spectrometry.

The dark resistivities of the a-Si layers were measured to obtain the result represented by a solid line B in FIG. 2.

The solid line B in FIG. 2 indicates that the a-Si photoconductive layer doped with neither boron nor phosphorus but containing oxygen and hydrogen only has a dark resistivity of about $5\times10^{11}$ ohm-cm which is about 1000 times as high as that of the layer free from oxygen but containing hydrogen only. With phosphorus present, the dark resistivity slightly decreases and further decreases with an increase in the phosphorus content. However, even when containing 1000 ppm of phosphorus, the a-Si layer still has a dark resistivity of more than $10^{11}$ ohm-cm. This reveals that the addition of oxygen remarkably improves the dark resistivity. On the other hand, when containing boron in addition to hydrogen and oxygen, the a-Si layer has a dark resistivity of about $2\times10^{12}$ ohm-cm with a boron content of 20 ppm, about $8\times10^{12}$ ohm-cm which is close to $10^{13}$ ohm-cm with a boron content of 200 ppm, and as high as about $1.5\times10^{13}$ ohm-cm with 2000 and 20000 ppm. Thus with $10^{-5}$ atomic % of oxygen and more than 200 ppm of boron present, the a-Si layer is satisfactorily usable as an electrophotographic photoconductive layer for forming image by the Carlson process. As compared with the oxygen-free but boron-containing a-Si layer of Experimental Example 1 at the same boron levels, the dark resistivity of the layer of this example is more than 1000 times that of the former at boron contents of 20 ppm and 200 ppm and is more than $10^6$ times as high as that of the former at 2000 ppm.

The dark resistivity of the a-Si photoconductive layer levels off when the boron content exceeds about 2000 ppm and remains substantially unaltered below about 20000 ppm but abruptly decreases as the boron content further increases.

Eight 20-micron-thick a-Si photoconductive layers were prepared in the same manner as above with the exception of incorporating about $10^{-2}$ atomic % of oxygen into each layer, one layer containing neither boron nor phosphorus, four layers containing 20, 200, 2000 and 20000 ppm of boron, and three layers containing 10, 100 and 1000 ppm of phosphorus. The dark resistivities of these layers were measured with the result represented by a solid line C in FIG. 2.

The dark resistivities obtained are generally about 10 times those represented by the solid line B in which case the oxygen content is about 1/1000 the content of the present case; with a boron content of 20 ppm, the resistivity increases from $2\times10^{12}$ ohm-cm to $3\times10^{13}$ ohm-cm, with a boron content of 200 ppm from $8\times10^{12}$ ohm-cm to $8\times10^{13}$ ohm-cm, and with a boron content of 2000 ppm and 20000 ppm from $1.5\times10^{13}$ ohm-cm to $1.5\times10^{14}$ ohm-cm.

The above results indicate that the a-Si photoconductive layer which must have a dark resistivity of at least about $10^{13}$ ohm-cm for use as an image-forming surface layer can incorporate therein about 20 ppm to a maximum of about 20000 ppm of boron when containing $10^{-5}$ to $10^{-2}$ atomic % of oxygen. However, as will become apparent from some of the experimental examples to follow, up to about $5\times10^{-2}$ atomic % of oxygen can be incorporated into the layer according to this invention, in which case the resulting dark resistivities are slightly higher than those indicated by the line C, such that with a boron content of about 10 ppm, a dark resistivity of about $10^{13}$ ohm-cm is available. Accordingly the boron content can be from about 10 to about 20000 ppm.

EXPERIMENTAL EXAMPLE 3

Ten a-Si layers, each 20 micron thick and containing about 200 ppm of boron, were prepared under the same conditions as in Experimental Example 2 except that oxygen was incorporated into the layers in varying amounts of 0.07 atomic %, 0.06 atomic %, 0.05 atomic %, 0.04 atomic %, 0.03 atomic %, 0.02 atomic %, 0.01 atomic %, $10^{-3}$ atomic %, $10^{-4}$ atomic % and $10^{-5}$ atomic %. The spectral sensitivities at the wavelength of 600 nm and charge accepting capabilities per 1 micron thickness of the layer were measured with the results shown in FIG. 3.

Figure 3:
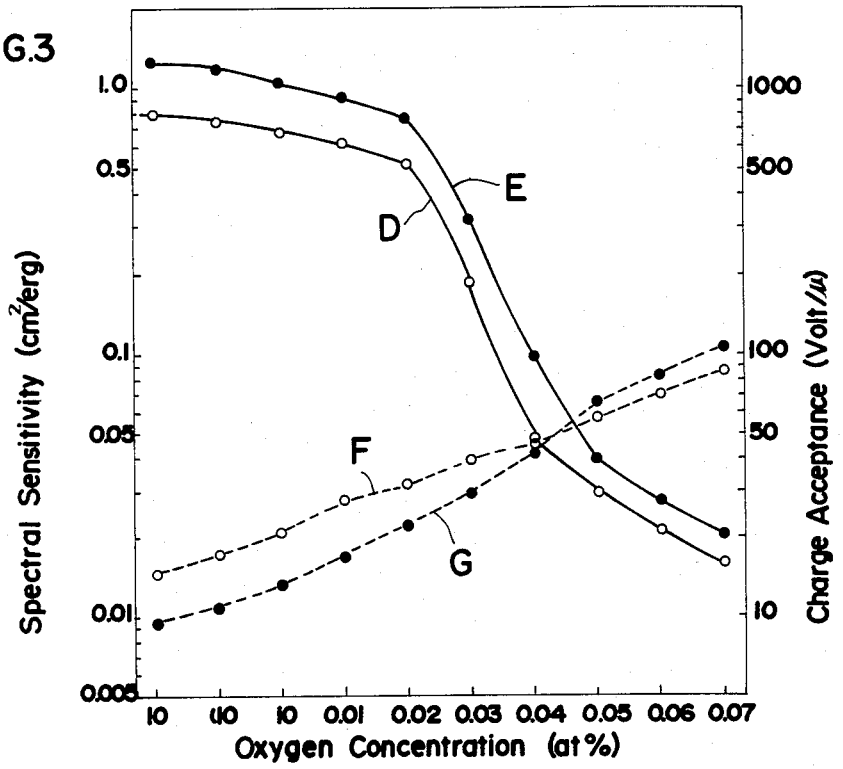
FIG. 3 is a diagram showing variations of the spectral sensitivity at 600 nm and charge accepting capability of amorphous silicon photoconductive layers having varying oxygen contents.

In FIG. 3, an oxygen concentration (atomic %) is taken on the abscissa, the spectral sensitivities S ($cm^2$/erg) on a left ordinate and the charge accepting capabilities Vo (Volt/u) on a right ordinate. The charge accepting capabilities Vo were measured by charging each of the layers positively and negatively by corona charging devices connected to ±5.6 KV voltage sources and subsequently measuring surface potentials which were then divided by 20 microns to plot in FIG. 3 as surface potential per one micron. For the determination of spectral sensitivities, each of the layers was positively and negatively charged and illuminated with light of 600 nm in wavelength to measure the amounts of light energy needed to reduce the surface potential to one half. As shown ○ marks are measured values of spectral sensitivities and charge accepting capabilities in the cases of positive chargings and are also drawn as curves D and F respectively. ● marks are measured values of spectral sensitivities and charge accepting capabilities in the cases of negative chargings and are also drawn as curves E and G respectively.

Examining at first the spectral sensitivities and charge accepting capabilities of a-Si layers containing 0.01 to 0.07 atomic % of oxygen, it is seen that the photosensitivity S of a-Si layer containing 0.01 atomic % of oxygen is as high as 0.62 $cm^2$/erg and that the charge accepting capability Vo is also as high as 28 volts per micron in the case of positive charging. On the other hand, the spectral sensitivity S is remarkably greater than 0.9 $cm^2$/erg although the charge accepting capability is somewhat lower and is −17 volts in the case of negative charging. With an oxygen content of 0.02 atomic %, the photosensitivities S are still as high as 0.52 $cm^2$/erg and 0.8 $cm^2$/erg in the cases of positive and negative chargings, respectively. The charge accepting capabilities Vo increase and are as high as 33 volts in the case of positive charging and −23 volts in the case of negative charging.

With the increase of the oxygen content, the photosensitivity decreases but the charge accepting capability increases. The a-Si layer containing 0.03 atomic % of oxygen exhibits the spectral sensitivities S of 0.18 $cm^2$/erg when positively charged and of 0.32 $cm^2$/erg when negatively charged. These values are much higher than the spectral sensitivities of conventional photosensitive members of Se and polyvinylcarbazole containing TNF. The charge accepting capabilities Vo are also high and are 40 volts and −30 volts respectively for positive and negative chargings. This means that a-Si layer of 20 micron thick can be charged to surface potentials of +800 volts and −600 volts. Relatively sharp drops in spectral sensitivities S are observed both in the cases of positive and negative chargings for a-Si layer containing 0.04 atomic % of oxygen although charge accepting capabilities have increased to 45 volts and −42 volts. With oxygen content of 0.04 atomic %, the spectral sensitivity S is just less than 0.05 $cm^2$/erg for positive charging and is about 0.1 $cm^2$/erg for negative charging. These sensitivity characteristics are higher or substantially equal to those of conventional photosensitive members and are sufficient to reproduce images with fine contrast.

Even with the oxygen content of 0.05 atomic %, the sensitivities S are as high as 0.03 $cm^2$/erg when positively charged and 0.04 $cm^2$/erg when negatively charged. The sensitivities exhibited by an a-Si layer containing 0.05 atomic % of oxygen are still sufficient for image reproduction but are limits for fine reproduction of images. This is clear since the a-Si layer containing 0.06 atomic % of oxygen which shows the sensitivities of 0.021 $cm^2$/erg and 0.027 $cm^2$/erg for positive and negative chargings respectively resulted in reproduction of somewhat poor contrast images even though the charge accepting capabilities Vo were as high as 70 volts and −82 volts. With the oxygen content increased to 0.07 atomic %, the sensitivities S were as low as 0.016 $cm^2$/erg and 0.02 $cm^2$/erg although Vo were as high as 86 volts and −105 volts. Such spectral sensitivities are too low for visible ray zone of 600 nm and in fact, images reproduced showed fogging and poor contrast. Accordingly, the oxygen content shoul be less than about 0.05 atomic %, preferably less than 0.04 atomic %.

With an oxygen content of less than 0.01 atomic %, i.e., with an oxygen content of $10^{-3}$ atomic %, the spectral sensitivities S are higher than the one with oxygen content of 0.01 atomic and are as high as 0.7 $cm^2$/erg when positively charged and more than 1.0 $cm^2$/erg when negatively charged. However, the charge accepting capabilities Vo drop and are about 21 volts and −13 volts. It is preferable, particularly when the layer is to be used for negative charging, to increase the thickness of the layer to at least about 5 microns. Instead, an a-Si barrier layer may be formed between the substrate and a-Si photoconductive layer. With an oxygen content of $10^{-4}$ atomic %, the sensitivities S are even higher and are as high as 0.76 $cm^2$/erg and 1.2 $cm^2$/erg for positive and negative chargings respectively. The charge accepting capabilities Vo are relatively low and are 17 volts and −11 volts respectively. Similarly, Vo of a-Si layer containing $10^{-5}$ atomic % of oxygen are as low as 15 volts and −9 volts and it is best to increase the thickness of the a-Si photoconductive layer to 5 to 10 microns, or to form the a-Si barrier layer since a minimum of surface potential of about ±300 volts is generally necessary for fine image reproduction.

In fact, with each of ten a-Si photoconductive layers subjected to charging, image exposure, magnetic brush development and image transfer onto copying paper respectively, fine images of good contrast were obtained from those containing 0.01 to 0.05 atomic % of oxygen. However, images of poor contrast were obtained from those containing 0.06 and 0.07 atomic % of oxygen. The a-Si layer containing $10^{-3}$ atomic % of oxygen reproduced an image of fine quality when positively charged but an image not so sharp and somewhat fogged was obtained when negatively charged. Similarly, fogged images of poor contrast were obtained from a-Si layer containing $10^{-4}$ and $10^{-5}$ atomic %. For this reason, three a-Si layers each having a thickness of 32 microns and respectively containing about $10^{-3}$, $10^{-4}$ and $10^{-5}$ atomic % of oxygen were prepared. Using these layers, the same experiments were conducted and the results showed reproduction of fine images from each of a-Si layers. Thus, a minimum oxygen content should be about $10^{-5}$ atomic % and a maximum of about $5\times10^{-2}$ atomic % as mentioned above. An oxygen content of about $10^{-2}$ to $4\times10^{-2}$ atomic % is preferable in view of spectral sensitivity and charge accepting characteristics. With an oxygen content of less than $10^{-5}$ atomic %, the dark resistivity falls and the charge accepting capability becomes too low.

EXPERIMENTAL EXAMPLE 4

Figure 4:
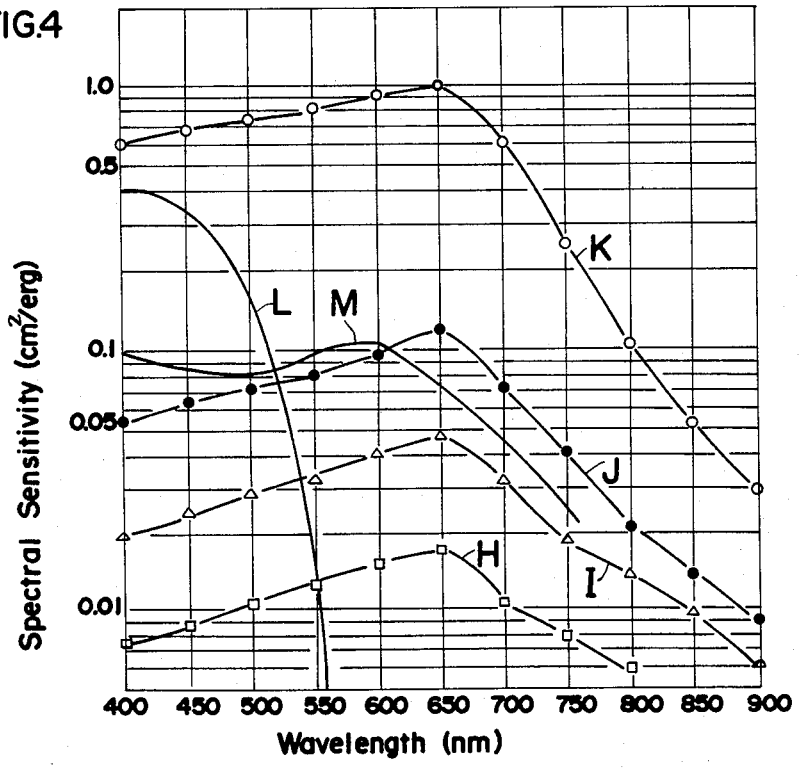
FIG. 4 is a diagram showing the spectral sensitivity characteristics of amorphous silicon phtoconductive layers having varying oxygen contents.

A-Si photoconductive layer having a thickness of 20 microns and containing 200 ppm of boron and 0.1 atomic % of oxygen was prepared under the same condition as in Experimental Example 3. Using also three a-Si photoconductive layers each containing 200 ppm of boron and 0.05 atomic %, 0.04 atomic % and 0.01 atomic % of oxygen respectively, which were prepared in Example 3, these layers were tested for spectral sensitivity characteristics. For the determination of spectral sensitivities, each of the layers was negatively charged with a corona charger connected to a voltage source of −5.6 KV and illuminated with light varying from 400 to 900 nm in wavelength to measure the amounts of light energy needed to reduce the surface potential to one half. The results are shown in FIG. 4, in which curves H, I, J and K represent the spectral sensitivity characteristics of the a-Si layers with the oxygen contents of 0.1, 0.05, 0.04 and 0.01 atomic %, respectively. For reference, curves L and M represent the spectral sensitivity characteristics of conventional photosensitive members, i.e. Se type and organic type of TNF-containing polyvinylcarbazole (1:1 in mole ratio), respectively.

FIG. 4 reveals that the lower the oxygen content, the higher are the spectral sensitivities. More specifically, the a-Si layer with an oxygen content of 0.1 atomic % has sensitivities (the curve H) which include a maximum of about 0.018 even at a peak wavelength of 650 nm and which are considerably lower than those of the above-mentioned organic sensitive member over the wavelength range of 400 to 600 nm, thus failing to achieve any improvement over the prior art. In contrast, the layer containing 0.05 atomic % of oxygen has spectral sensitivities (the curve I) which are about 2 to about 3 times as high as those represented by the curve H and which are comparable or higher than these of the conventional photosensitive member (the curves L and M) especially over the range of longer wavelengths. The layer is therefore fully useful. These results also substantiate the foregoing requirement of the invention that the oxygen content of the a-Si photoconductive layer should be up to 0.05 atomic %. Curve J represents the spectral sensitivity characteristics of the a-Si layer containing 0.04 atomic % of oxygen, and as shown, the sensitivities are about twice as high as the one with the oxygen content of 0.05 atomic % and higher than that of the conventional photosensitive member of organic type (the curve M) particularly in the longer wavelengths. When the oxygen content decreases further to 0.01 atomic %, the spectral sensitivities (the curve K) are about 9 to 10 times the sensitivities obtained with the oxygen content of 0.04 atomic % (the curve J). Such a-Si layer provides a photosensitive member which is more sensitive than any other conventional like members.

EXPERIMENTAL EXAMPLE 5

Photosensitive members were prepared each comprising a substrate, an a-Si photoconductive layer and an a-Si barrier layer formed therebetween. The barrier layers of the members contained varying amounts of oxygen. The sensitive members were tested for initial surface potential and residual potential.

The glow discharge apparatus shown in FIG. 1 was used. First, the interior of the reactor tube 21 was evacuated to a vacuum of about $10^{-5}$ Torr by the diffusion pump 27, and the rotary pump 26 was thereafter alternatively driven to produce a vacuum of about $10^{-3}$ Torr. In this state, the mass flow controller 12 was adjusted to give a pressure of 0.03 Torr for the supply of oxygen from the fourth tank 4. At the same time, $SiH_4$ gas was released from the first tank 1 with use of hydrogen as a carrier gas (10% $SiH_4$ relative to hydrogen), and $B_2H_6$ gas from the second tank 2 in an amount corresponding to a $B_2H_6/SiH_4$ mole ratio of $10^{-4}$. At this time, the reactor tube was maintained at a total pressure of 0.7 Torr. The substrate was maintained at a temperature of 200° C., and the resonance vibration coil 22 was set to give a high-frequency power of 300 W at a frequency of 4 MHz for glow discharge, whereby an a-Si barrier layer was formed on the aluminum substrate at a rate of about 1 micron/60 minutes. After 30 minutes, the glow discharge was discontinued. The resulting a-Si barrier layer had a thickness of 0.5 micron, an oxygen content of 0.05 atomic % and a boron content of 20 ppm.

Subsequently, while maintaining the $SiH_4$ and $B_2H_6$ gases at the same pressure levels as above, with the mass flow controller 12 adjusted to give an oxygen pressure of about 0.005 Torr, glow discharge was effected again for 8 hours to form an 8-micron-thick a-Si photoconductive layer containing about 0.01 atomic % of oxygen and 20 ppm of boron. As stated in Experimental Example 2. the layer had a dark resistivity of about $3\times10^{13}$ ohm-cm.

In the same manner as above, six sensitive members were prepared with the same construction as above except that varying amounts of oxygen were incorporated into the a-Si barrier layers. Thus glow discharge was effected under the same conditions except that for the formation of the barrier layers, the mass flow controller 12 was adjusted to give varying oxygen pressures of 0.05, 0.09, 0.22, 0.35, 0.50 and 0.70 Torr. The resulting sensitive members were each composed of a substrate, a 0.5-micron-thick a Si barrier layer formed over the substrate and containing oxygen and 20 ppm of boron, and an 8-micron-thick a-Si photoconductive layer formed over the barrier layer and containing 0.01 atomic % of oxygen and 20 ppm of boron. In corresponding relation to the above-mentioned oxygen pressures, the barrier layers of the six sensitive members had oxygen contents of 0.08, 0.16, 0.3, 0.4, 0.5 and 0.6 atomic %. Similarly another sensitive member was prepared which had an a-Si photoconductive layer directly formed over a substrate. This sensitive member corresponds to one in which the a-Si barrier layer is free from oxygen. The oxygen contents of the layers were measured by Spark Source mass spectrometry, and the boron contents with an ion microanalyzer.

Figure 5:
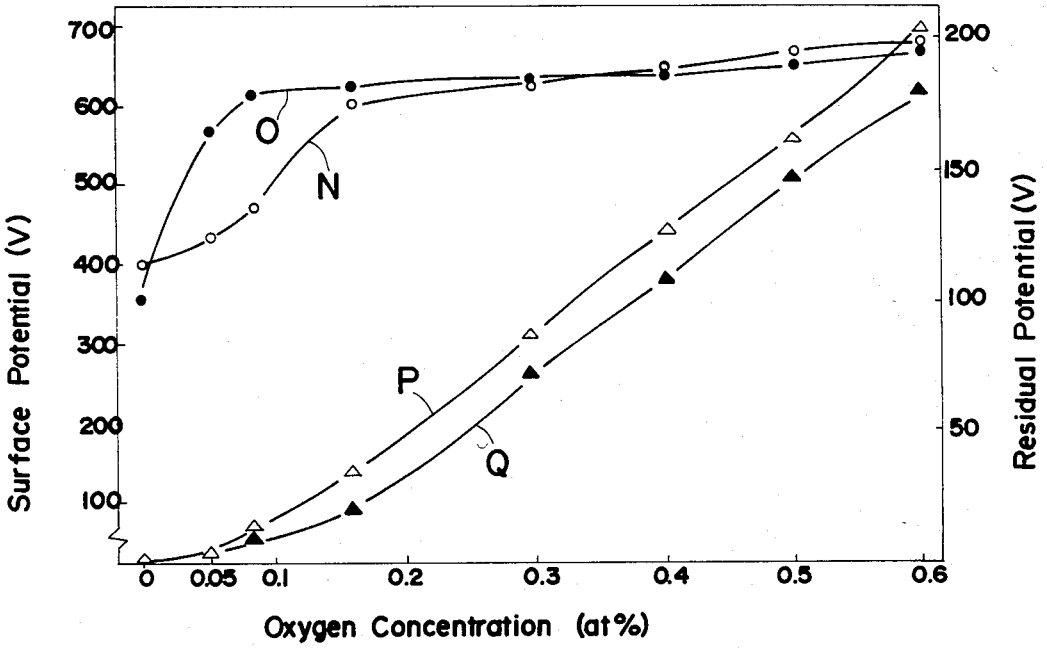
FIG. 5 is a diagram showing the relation of the oxygen content of amorphous silicon barrier layers with the initial surface potential and with the residual potential.

Each of the sensitive member was uniformly charged to positive and negative polarities by a corona charger connected to a voltage source of ±7 KV, and was checked for charge accepting capacity by measuring the initial surface potential. Subsequently the member was illuminated with light in an amount of 0.3 mw.sec/cm$^2$ and checked for residual potential after decay. The results are shown in FIG. 5, in which the oxygen content of the a-Si barrier layer is plotted on the abscissa, the initial surface potential as left ordinate, and the residual potential as right ordinate. A curve N represents the relation between the oxygen content and the initial surface potential applied by positive charging, and a curve O a like relation determined by negative charging. Curves P and Q represent the relations of the oxygen content to the residual potentials due to positive charging and negative charging, respectively.

FIG. 5 shows that the sensitive member in which the a-Si barrier layer contains no oxygen, i.e. which does not have the barrier layer, retains little or no residual potential when charged positively or negatively, but has low initial surface potentials of 400 V when charged positively and −360 V when charged negatively, although the low potentials are partly attributable to the fact that the a-Si photoconductive layer is as thin as 8 microns. However, the sensitive member containing 0.05 atomic % of oxygen in its a-Si barrier layer has a remarkably increased initial surface potential of as high as −560 V when charged negatively as shown by the curve O and is also positively chargeable to a slightly increased potential. The presence of oxygen therefore renders the sensitive member chargeable to such a high potential that the a-Si photoconductive layer, although thin, can be used as an image-forming surface layer. With a further increase of the oxygen content of 0.08 atomic %, the sensitive member has increased initial surface potentials of −600 V when charged negatively and +470 V when charged positively, and nevertheless retains low residual potentials of ±10 to 20 V. This assures that highly contrasty copy images are available.

When the sensitive member contains 0.16, 0.3, 0.4, 0.5 or 0.6 atomic % of oxygen in the a-Si barrier layer, the negative initial surface potential levels off in the neighborhood of about −620 to about −670 V with the increase of the content, while the positive initial surface potential increases to +600 V with the oxygen content of 0.16 atomic % and levels off at about +620 to about +675 V with a further increase of the oxygen content as is the case with negative charging. On the other hand, the residual potentials are −20 V and +35 V with 0.16 atomic % of oxygen present, −75 V and +90 V with 0.3 atomic %, −110 V and +125 V with 0.4 atomic %, −145 V and +160 V with 0.5 atomic %, and −180 V and +205 V with 0.6 atomic %, thus increasing with the increase of the oxygen content. Since the inventors have found that when the oxygen content is in such a range that the residual potentials are above ±100 V, the initial surface potentials are as high as above ±600 V, and that even if the residual potentials are about ±150 V when highest, fully contrasty copy images are available, the oxygen content of the a-Si barrier layer is preferably about 0.05 to about 0.5 atomic %. If the oxygen content is less than about 0.05 atomic %, the barrier layer itself fails to fully prevent the injection of charges from the substrate, whereas if it is above about 0.5 atomic %, the sensitive member will have residual potentials of above ±150 V, failing to afford contrasty copy images. Accordingly it is suitable that the oxygen content be about 0.05 to about 0.5 atomic %. The reason why the sensitive member is not positively chargeable to a noticeably increased initial surface potential when the oxygen content of the a-Si barrier layer is not higher than about 0.08 atomic % is presumably that the layer itself has rectifying properties.

EXPERIMENTAL EXAMPLE 6

Sensitive members including a-Si barrier layers which had an oxygen content of 0.08 atomic % and varying thickness were tested to determine the relation of the thickness to the initial surface potential of the sensitive member as well as to the residual potential thereof. The sensitive members prepared were one having an a-Si barrier layer with a thickness of 0.5 micron and an oxygen content of 0.08 atomic %, the same as one made in Experimental Example 5, another one having an a-Si photoconductive layer formed directly on a substrate without any a-Si barrier layer, and others including a-Si barrier layers each containing 0.08 atomic % of oxygen and having varying thicknesses of 1 micron, 2.4 microns, 3 microns, 4 microns, 5 microns and 6 microns. Each of the sensitive members was then charged and exposed to light under the same conditions as in Experimental Example 5 to measure the initial surface potential and residual potential.

Figure 6:
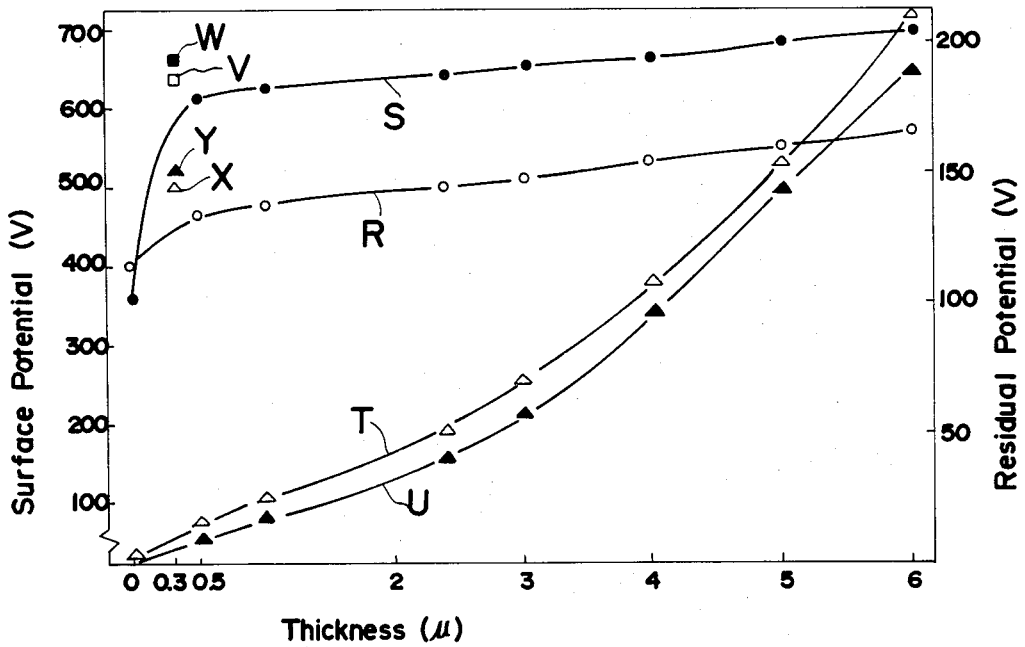
FIG. 6 is a diagram showing the relation of the thickness of amorphous silicon barrier layers with the initial surface potential and with the residual potential.

The results are shown in FIG. 6, in which the thickness of the a-Si barrier layer is plotted on the abscissa, the initial surface potential as left ordinate, and the residual potential as right ordinate. Curves R and S represent the relations of the thickness to the initial surface potential applied by positive and negative charging, respectively. Curves T and U represent the relations of the thickness to the residual potentials resulting from positive and negative charging, respectively. FIG. 6 shows that the sensitive member in which no barrier layer is formed has low initial surface potentials of 400 V when charged positively and −360 V when charged negatively. However, the sensitive member with the 0.5-micron-thick a-Si barrier layer (containing 0.08 atomic % of oxygen) has a remarkably increased initial surface potential of as high as −600 V and is positively chargeable also to an increased potential of 470 V. Thus the fact that the presence of the 0.5-micron-thick a-Si barrier layer results in increased initial surface potentials which permit formation of images by the electrophotographic process means that similarly increased initial surface potentials are available also when the thickness is smaller. FIG. 6 shows that the thickness, when not smaller than about 0.2 micron, assures that the initial surface potential will not be lower than is required. As the thickness increases to 1 micron, the initial surface potentials increase to +475 V and −625 although slightly and, at the same time, the residual potentials also increase to +25 V and −20 V. With a further increase in the thickness, the initial surface potentials somewhat rise but tend to level off, whereas the residual potentials further increase. More specifically, the initial potentials are +500 V and −630 and the residual potentials are +50 V and −40 V with the thickness of 2.4 microns, the initial potentials are +505 V and −650 and the residual potentials are +70 V and −60 V with 3 microns, the initial potentials are +530 V and −670 V and the residual potentials +110 V and −95 V with 4 microns, the initial potentials are 550 V and −680 V and the residual potentials are +155 V and −145 V with 5 microns, and the initial potentials are +570 V and −700 V and the residual potentials are +210 V and −185 V with 6 microns. Since fully contrasty copy images can be obtained when the residual potentials are up to about ±135 V as already stated, it is seen from FIG. 6 that the thickness of the a-Si barrier layer can be about 5 microns at the largest. The minimum thickness is about 0.2 micron as previously mentioned.

Another sensitive member was prepared with the same construction as above except that the a-Si barrier layer had a thickness of 0.3 micron and an oxygen content of 1 atomic %. In the same manner as above, the sensitive member was charged and exposed to light to determine the initial surface potentials and residual potentials. FIG. 6 shows the results, i.e. the initial surface potentials V and W applied by positive and negative charging, respectively, and the residual potentials X and Y due to positive and negative charging, respectively. The initial surface potentials are +630 V and −660 V which are sufficient for forming an image, while the residual potentials are about ±150 V which assure production of contrasty copy images. This means that when the a-Si barrier layer has a small thickness, for example, of about 0.3 microns, the oxygen content can be more than 0.5 atomic %. As will be apparent from the foregoing measurements, the residual potentials are about ±150 V which are the upper limits, although the layer contains 1 atomic % of oxygen. Accordingly provided that the barrier layer has a small thickness, up to 1 atomic % of oxygen can be incorporated into the layer. The small thickness as mentioned is not limited to 0.3 micron; the oxygen content can be up to a maximum of 1 atomic % when the thickness is about 0.2 to about 0.4 micron.

Next, each of these photosensitive members prepared in Examples 5 and 6 were subjected to image formation tests by charging them positively and negatively with corona chargers connected to voltage sources of ±7 KV, image exposing, developing with toner by magnetic brush and image transferring onto copying papers. As the result, fine images of high contrast were obtained from all photosensitive members with the exception of the members having a-Si barrier layers of 0.5 micron thick and containing 0.6 atomic % of oxygen and of 6 micron thick and containing 0.08 atomic % of oxygen which reproduced fogged images of poor contrast. The one with no a-Si barrier layer produced a good quality image although somewhat inferior to the images produced from sensitive members having a-Si barrier layers of 0.5 micron thick and containing respectively 0.05, 0.08, 0.16, 0.3, 0.4 and 0.5 atomic % of oxygen and these having a-Si barrier layers containing 0.08 atomic % of oxygen and respectively 1, 2.4, 3, 4 and 5 micron thick. The sensitive member having a-Si barrier layer of 0.3 micron thick and containing 1 atomic % of oxygen also reproduced an image of fine quality.

Numerous modifications and variations of the present invention are possible in light of the above teachings and, therefore, within the scope of the appended claims, the invention may be practiced otherwise than as particularly described.

What is claimed is:

1. An electrophotographic sensitive member which comprises a substrate, a barrier layer of amorphous silicon having a thickness of about 0.2 to 5 microns and containing about 0.05 to 1 atomic % of oxygen and a photoconductive layer of amorphous silicon formed on said barrier layer and containing about $10^{-5}$ to $5\times10^{-2}$ atomic % of oxygen, about 10 to 40 atomic % of hydrogen and about 10 to 20000 ppm of a Group III*a* impurity of the Periodic Table.

2. An electrophotographic sensitive member as claimed in claim 1 wherein both of said barrier layer and said photoconductive layer are formed by the glow discharge process.

3. An electrophotographic sensitive member as claimed in claim 1 wherein said barrier layer preferably contains about 0.05 to 0.5 atomic % of oxygen and as much as about 1 atomic % of oxygen when the thickness is about 0.2 to 0.04 micron.

4. An electrophotographic sensitive member as claimed in claim 2 wherein said impurity is boron.

5. An electrophotographic sensitive member which comprises, a barrier layer of amorphous silicon formed by the glow discharge process and having a thickness of about 0.2 to 5 micron and containing about 0.05 to 0.5 atomic % of oxygen but containing as much as about 1 atomic % when the thickness is about 0.2 to 0.4 micron, and a photoconductive layer of amourphous silicon formed by the glow discharge process and having a thickness of about 5 to 100 microns, said photoconductive layer including about $10^{-5}$ to $5\times10^{-2}$ atomic % of oxygen, about 10 to 40 atomic % of hydrogen and about 10 to 20000 ppm of boron.

6. An electrophotographic sensitive member as claimed in claim 2 wherein said barrier layer preferably contains about 0.05 to 0.5 atomic % of oxygen and as much as about 1 atomic % of oxygen when the thickness is about 0.2 to 0.4 micron.

* * * * *